US005476050A

United States Patent [19]

Zimmer et al.

[11] Patent Number: 5,476,050

[45] Date of Patent: Dec. 19, 1995

[54] SINGLE BEAM AERIAL WORK PLATFORM

[75] Inventors: Kenneth J. Zimmer, Fond du Lac; Thomas J. Loomans, West Bend; Lee L. Lemke, Cecil, all of Wis.

[73] Assignee: Mayville Engineering Company, Inc., Mayville, Wis.

[21] Appl. No.: 234,445

[22] Filed: Apr. 28, 1994

Related U.S. Application Data

[63] Continuation of Ser. No. 114,798, Aug. 31, 1993, abandoned.

[51] Int. Cl.[6] ..... A47B 9/00

[52] U.S. Cl. ..... 100/145; 254/122; 100/147

[58] Field of Search ..... 108/145, 147, 108/144; 254/122; 182/69, 148; 248/277, 421

[56] References Cited

U.S. PATENT DOCUMENTS

| | | | |
|---|---|---|---|
| 2,706,102 | 4/1955 | Cresci | 108/145 X |
| 3,203,670 | 8/1965 | Farris | 254/122 |
| 3,596,735 | 8/1971 | Denier et al. | 182/148 X |
| 3,982,718 | 9/1976 | Folkenroth et al. | 254/122 X |
| 4,582,310 | 4/1986 | Hahn | 254/122 X |
| 4,690,250 | 9/1987 | Bergstrom | 254/122 X |
| 5,145,029 | 9/1992 | Blasdell, Jr. et al. | 182/69 X |

FOREIGN PATENT DOCUMENTS

| | | | |
|---|---|---|---|
| 3104182 | 12/1981 | Germany | 108/145 |
| 981991 | 2/1965 | United Kingdom | 108/147 |

*Primary Examiner*—Jose V. Chen
*Attorney, Agent, or Firm*—Dowell & Dowell

[57] ABSTRACT

A single beam aerial work platform with a base structure, top structure, and at least three scissor mechanisms. A hydraulic cylinder for raising the top structure relative to the base structure is attached between the first or lower scissor mechanism and the third or top scissor mechanism. The hydraulic cylinder is attached by a mounting bracket at an offset to the pivot points and structural members of the scissor mechanisms. An additional stress reducing beam, attached parallel to one of the structural members of the middle scissors mechanism, reduces the horizontal bending stress in the structural members of the scissor mechanisms and the connecting pin loading in the scissor mechanism pins.

12 Claims, 2 Drawing Sheets

SINGLE BEAM AERIAL WORK PLATFORM

This is a continuation application of U.S. Ser. No. 08/114,490, filed Aug. 31, 1993, now abandoned.

BACKGROUND OF THE INVENTION

Aerial work platforms are often utilized to enable a person to access areas high above reach to install fixtures, perform maintenance, or the like. Unlike a ladder, which must lean against a solid object or have a second set of supports to be free standing, an aerial work platform is self contained, mobile, stable, and provides a large platform surface upon which the user can work. The disadvantages of most aerial work platforms are their physical size both when collapsed and extended and the mount of energy required to activate their extending means to raise the platform to the desired height.

The aerial work platform of the present invention has many features and accomplishes many objectives which overcome these disadvantages and distinguish it from the prior art. First, the present invention is an aerial work platform of the single scissors type. My aerial work platform utilizes only one set of scissor type structures or beams for lifting purposes. This greatly reduces the overall width of the aerial work platform and allows its use in areas where it was previously impossible to locate an aerial work platform because of space limitations. Likewise, its structure is lighter and more compact than traditional two scissors type aerial work platforms.

Another object of the present invention is to provide an aerial work platform that requires only one extending means, typically a hydraulic cylinder. Furthermore, because of the unique and novel positioning of the extending means, the amount of work required by said extending means is greatly reduced.

Typically, at least one end of the extending means of single scissors prior art aerial work platforms is connected to the aerial work platform's base structure. My aerial work platform's extending means, typically a hydraulic cylinder, is connected between the first pair of scissors mechanism and the third pair of scissor mechanism using offset mounting assemblies. Due to the resulting mechanical advantage derived from the position of each end of the extending means on each mounting assembly, a smaller and more efficient hydraulic cylinder and hydraulic oil pump for raising the work platform are utilized by my invention.

A further object of my invention is to reduce the side bending forces and connecting pin loading of the aerial work platform. The present invention utilizes an additional support member or beam which is attached substantially or somewhat parallel to its extending means to reduce the side bending in the single scissor mechanisms and to reduce the connecting pin loading caused by the hydraulic cylinder loading.

SUMMARY OF THE INVENTION

The present invention comprises a single scissors or beam aerial work platform with a base structure, a top structure, and at least three pair of scissor beam mechanisms. Each pair of scissor beam mechanisms comprises a pair of structural members or beams, each with an aperture at the center. The pair is pivotally connected at their center apertures with suitable connecting means, typically a pin, thus forming a scissor beam mechanism. Each pair has a pair of lower ends below the center aperture with end portions containing second and third apertures and upper ends above the center aperture with end portions containing fourth and fifth apertures.

The end portions of the lower ends of the first or bottom pair of scissors mechanism are connected to the base structure. One end is rigidly connected to the base by passing a pin through the aperture in the end portion of the beam and through a similar aperture in the base structure. The other beam end is slidably connected to the base structure. The ends of the pin that pass through the aperture in the end portion of this beam slide in a track on the base structure. As the aerial work platform is raised or lowered, this first scissor mechanism closes and opens. The pin slides in the track accordingly. The end portions of the upper ends of the first pair of scissors mechanism are connected to the end portions of the lower ends of the second or middle pair of scissors mechanism with pins that pass through the apertures in each members end portions. Similarly, the end portions of the upper ends of the second pair of scissors mechanism are connected to the end portions of the lower ends of the third or top pair of scissors mechanism with pins. Finally, the end portions of the upper ends of the third pair of scissors mechanism are connected to the top structure of the lifting means with a fixed pin and a pin that slides in a track identical to that described in the base structure.

Attached to the upper portion of the first or bottom scissor mechanism between a center aperture and an upper aperture and attached to the lower portion of the third or top scissor mechanism between a center aperture and a lower aperture are hydraulic cylinder mounting assemblies. The mounting assemblies comprise at least one side plate on either side of the extending means. The ends of the extending means, typically a hydraulic cylinder, for extending the top structure relative to the base structure are connected to the hydraulic cylinder mounting assemblies. The points of connection for the extending means are offset from the pins of each pair of scissors mechanisms to produce a mechanical advantage. The design criterion for determining the offset location are the hydraulic pressure required to start raising the top structure, the existing hydraulic pressure when the top structure is at full raise, and the stresses and loads of the stress reducing beam. An additional structural member or stress reducing beam runs parallel to one of the structural members of the second set of scissors mechanism and is connected to the lower pin of the upper hydraulic cylinder mounting assembly and to the upper pin of the lower hydraulic cylinder mounting assembly.

My aerial work platform is not limited to three sets of pairs of scissor beam mechanisms. An additional set of scissor beam mechanisms can be attached to the top of the third set. This would in tun increase the maximum height of the aerial work platform. For example, another three sets could be added to double the maximum height. Provided each addition of three sets includes an additional extending means, my aerial work platform can be extended to any desired height provided structural integrity is taken into consideration.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
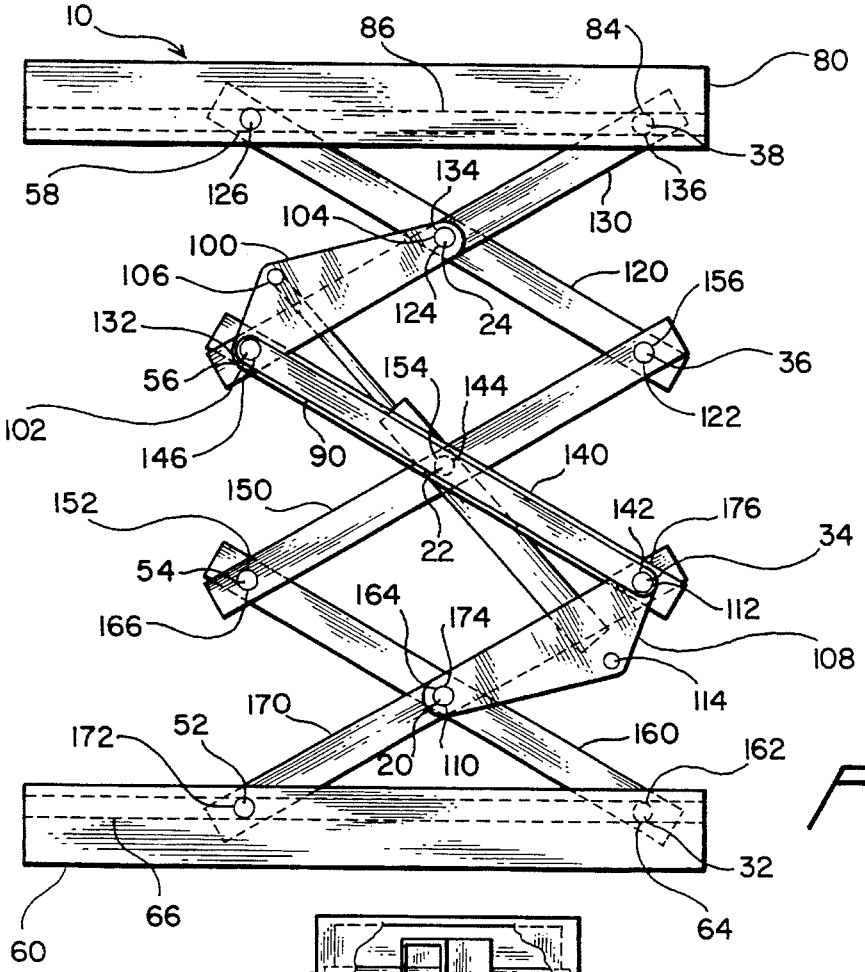
FIG. 1 is a side elevational view of my aerial lift platform.
Figure 2:
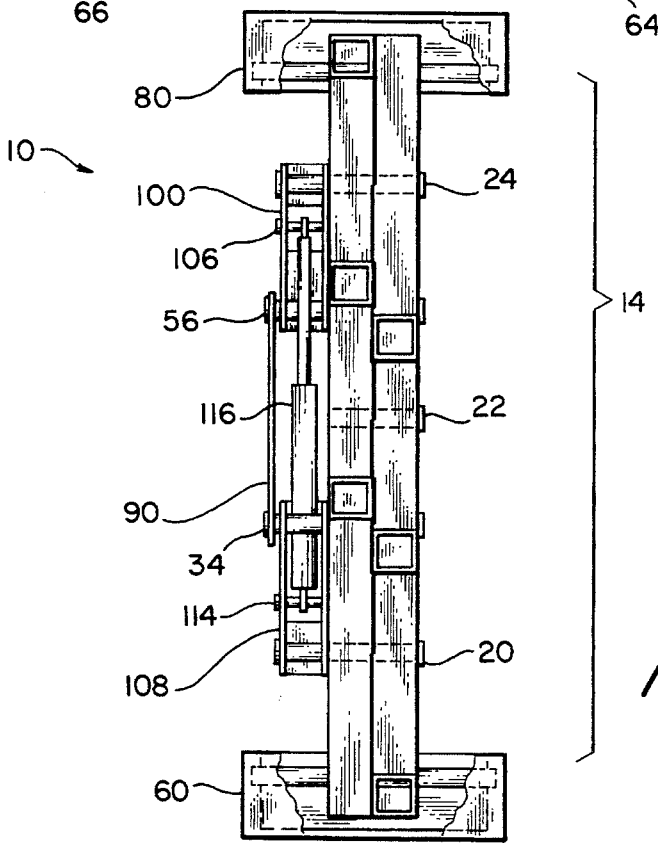
FIG. 2 is a front elevational view of my aerial lift platform.
Figure 3:
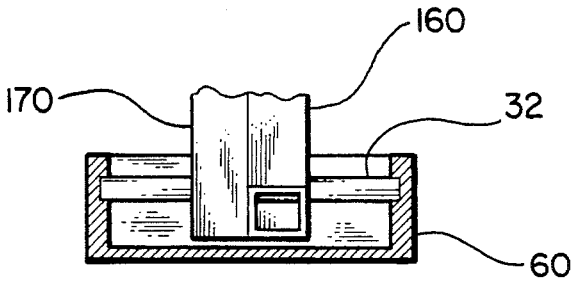
FIG. 3 is a cross-sectional view of the base structure of my aerial lift platform taken on line 3—3 of FIG. 1.
Figure 5:
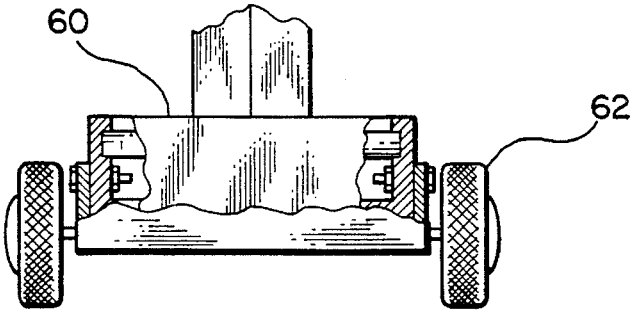
FIG. 5 is a partial elevational view of the base structure of my aerial lift platform showing its wheels.

The embodiment of my invention will be referred to as 10 and is shown in FIGS. 1 and 2. Referring to FIGS. 1 and 2, my aerial work platform includes a base 60, a scissors lift assembly 14, and a top structure 80. As can be seen in FIG. 5, the base 60 includes wheels 62 for mobility of the aerial lift platform. Referring to FIG. 1, the base 60 contains an aperture 64 and a slide track 66. Beam 160 of scissor assembly 14 is pivotally attached to base 60 by pin 32 which passes through aperture 64 and a similar aperture 162 in beam 160. Beam 170 of scissor assembly 14 is slidably attached to base 60. Pin 52, which passes through aperture 172 in beam 170, is slidably engaged into track 66. As scissor assembly 14 expands and collapses, pin 52 traverses in track 66 accordingly. Base 60 and pin 52 are also shown in FIG. 3.

Figure 4:
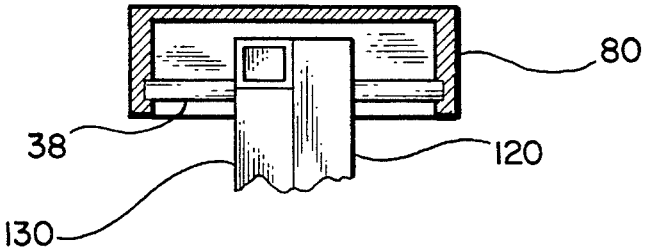
FIG. 4 is a cross-sectional view of the top structure of my aerial lift platform taken on line 4—4 of FIG. 1.

Referring to FIGS. 1 and 2, the top structure 80 also contains an aperture 84 and a slide track 86. Beam 130 of scissor assembly 14 is pivotally attached to top structure 80 by pin 38 which passes through aperture 84 and a similar aperture 136 in beam 130. Beam 120 of scissor assembly 14 is slidably attached to top structure 80. Pin 58, which passes through aperture 126 in beam 120, is slidably engaged into track 86. As scissor assembly 14 expands and collapses, pin 58 traverses in track 86. Top structure 80 and pin 58 are also shown in FIG. 4.

Scissor assembly 14 includes at least 3 sets of pairs of structural members or beams which each form a scissors mechanism. Each pair has a center aperture through which a common pin passes thus forming each scissor mechanism. The pairs of ends of each scissor mechanism are attached to either another pair of ends or to base structure 60 or to top structure 80.

The first pair of scissors mechanism is formed by beams 160 and 170 whose center apertures 164 and 174 are pivotally pinned together by pin 20. The lower ends of beams 160 and 170 are attached to base 60 as described above. The upper ends of beams 160 and 170 are pivotally attached to the lower ends of beams 150 and 140 by pins 54 and 34 respectively. Pin 54 passes through aperture 166 in beam 160 and aperture 152 in beam 150. Pin 34 passes through aperture 176 in beam 170 and aperture 142 in beam 140. Beams 140 and 150, which are pivotally connected at their center apertures 144 and 154 respectively by pin 22, form the second pair of scissors mechanism. The upper ends of beams 140 and 150 are in turn pivotally attached to the lower ends of beams 130 and 120 by pins 56 and 36 respectively. Pin 56 passes through aperture 146 in beam 140 and aperture 132 in beam 130. Pin 36 passes through aperture 156 in beam 150 and aperture 122 in beam 120. Beams 120 and 130 are pivotally attached at their center apertures 124 and 134 respectively by pin 24. The upper ends of beams 120 and 130 are attached to top structure 80 as described above.

The hydraulic cylinder 116 applies a lifting force to the first and third scissor mechanisms through the upper and lower hydraulic cylinder mounting assemblies 100 and 108. The mounting assemblies 100 and 108 comprise at least one side plate mounted on either side of the extending means. Each mounting assembly 100 and 108 has three apertures. Upper hydraulic cylinder mounting assembly 100 lies along side beam 130. Pin 56, which is pivotally connected to beams 130, 140, and 90, passes through aperture supports a pivot pin 102 of the upper hydraulic cylinder mounting assembly 100. Pin 24, which pivotally connects beams 130 and 120, passes through aperture 104 in upper mounting assembly 100. The third aperture 106 of upper mounting assembly 100, to which one end of the hydraulic cylinder 116 is mounted, is offset from pin 56 by a predetermined distance and angle. The design criterion which determine the offset dimensions for the location of aperture 106 are the hydraulic pressure that is present at the start of raising the top structure, the hydraulic pressure that exists when the top structure is at full raise, and the stresses and loads of beam 130. Lower hydraulic cylinder mounting assembly 108 is placed along side beam 170. Apertures 110 and 112 of lower mounting assembly 108 fit over pins 20 and 34 respectively. Mounting assembly 108 has a third pivot pin 114, to which the other end of the hydraulic cylinder 116 is attached, offset from pin 34 by a different predetermined distance and angle. The same design criteria are used to determine the offset location of aperture 114. The cylinder mounting assemblies 100 and 108 provide for reduced distortion of the beams caused by bending forces during raising of the aerial work platform. Hydraulic cylinder mounting assemblies 100 and 108 and beam 90 reduce the load and stress in pins 20, 24, 34, and 56. In addition, cylinder mounting assemblies 100 and 108 are easily replaced when worn and significantly reduce the repair time required when the hydraulic cylinder must be removed for maintenance purposes.

An additional beam 90 is used to further reduce side bending caused by hydraulic cylinder loading in the single scissors mechanism beams. This stress reducer beam 90 reduces the horizontal bending forces in the scissors beams by supporting pins 34 and 56 outside of the hydraulic cylinder mounting assemblies 100 and 108. Stress reducing beam 90 not only shares the load from the hydraulic cylinder 116 but because of its placement outboard of hydraulic cylinder 116 it is in a position to carry the forces with very little bending. It also reduces the pin stresses and the pin deflections by changing originally cantilevered pins 34 and 56 into end supported pins 34 and 56. Pins supported at both ends are more rigid and can withstand a greater load. Stress reducer beam 90 carries primarily an axial load and therefore its cross-section area is only one fourth of that of the scissors beams. Stress reducing beam 90 has replaceable bearings on each end.

Additional scissor assemblies 14 can be pivotally connected to the third pair of scissors mechanism to increase the maximum height of my aerial work platform. The only limitation is structural integrity of the components.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A scissors lift comprising;

a top structure;

a base structure;

a plurality of scissor mechanisms being interconnected between the top structure and the base structure;

said plurality of scissor mechanisms including a lower scissor mechanism and at least two upper scissor mechanisms, each of said plurality of scissor mechanisms having first and second beams having upper and lower end portions and central portions, central connecting means for pivotally connecting each of said first and second beams of each of said plurality of scissor mechanisms at their central portions, a first pair of connecting means for pivotally connecting said lower end portions of said first and second beams of said lower scissor mechanism to said base structure, a plurality of end connecting means for pivotally connecting each of said lower end portions of said first and second beams of said at least two upper scissor mechanisms in end-to-end relationship to said upper end portions of said first and second beams of an adjacent of said plurality of scissor mechanisms;

an extending means having first and second ends;

upper and lower mounting means for mounting the extending means to the scissor lift;

said lower mounting means being mounted to both said center connecting means and a first one of said end connecting means which is connected to said upper end portion of one of said first and second beams of said first scissor mechanism so as to distribute stresses to said center connecting means and said first one of said end connecting means, said upper mounting means being mounted to both a second one of said end connecting means of one of said upper scissor mechanisms which is oriented diagonally with respect to said first one of said end connecting means and to the next upper vertically spaced one of said center connecting means so as to distribute stresses therebetween;

first pivot means for connecting said first end of said extending means to said lower mounting means, said first pivot means being spaced from said center connecting means of said first scissor mechanism and said first one of said end connecting means, and second pivot means for pivotally connecting said second end of said extending means to said upper mounting means, said second pivot means being spaced from said second one of said end connecting means of said one of said upper scissor mechanisms and said next upper vertically spaced center connecting means.

2. The scissors lift of claim 1 in which the extending means is a hydraulic cylinder.

3. The scissors lift of claim 1 in which each of said upper and lower mounting means includes:

side plates on opposite sides of the extending means;

each side plate having first, second and third spaced apertures therethrough;

said first and second apertures of each plate lying in a center line and receiving an end connecting means and a central connecting means therethrough, respectively;

said third aperture of each plate being located a distance from the center line and receiving one of said first and second pivot means therethrough.

4. The scissors lift of claim 1 further comprising a stress reducing beam extending between and connected to said first and second one of said end connecting means for reducing bending of the scissors lift during extension and retraction of said plurality of scissor mechanisms.

5. The scissors lift of claim 4 in which said upper mounting means is connected to said central connecting means of a second upper scissor mechanism spaced from said lower scissor mechanism.

6. A scissor lift for an aerial work platform comprising:

at least first, second and third pivotally connected scissor mechanisms each having a pair of beams having upper and lower ends, a base structure, said first scissor means being pivotally connected to said base structure, a top structure, an extending means with two ends, at least one stress-reducing member having a first end and a second end;

center connecting means for pivotally connecting each of said pair of beams in relationship to one another;

end connecting means for pivotally connecting the upper ends of said pair of beams of said first and second scissor mechanisms with said lower ends of said pair of beams of said second and third scissor mechanisms;

lower mounting means for connecting one end of said extending means to said center connecting means and a first of said end connecting means of said first scissor mechanism and upper mounting means for connecting the other end of said extending means to said center connecting means of said third scissor mechanism and a second of said end connecting means of said second scissor mechanism which is diagonally oriented in relation to said first end connecting means;

said first end of the stress-reducing member being connected to said first end connecting means of said first scissor mechanism and said second end of said stress-reducing member being connected to said second end connecting means of said second scissor mechanism whereby the stress-reducing member extends substantially parallel to one of said pair of beams of said second scissor mechanism.

7. The scissor lift assembly for an aerial work platform for claim 6 in which said extending means is a hydraulic cylinder.

8. The scissor lift assembly for an aerial work platform of claim 6 in which each upper and lower mounting means includes:

a side plate on opposite sides of said extending means;

each side plate having first, second and third apertures;

said first and second apertures lying in a center line and receiving an end connecting means and a central connecting means therethrough, respectively;

said third aperture being located a distance from the center line and receiving a pivot means therethrough to which said said extension means is connected.

9. An aerial work platform comprising:

a base structure;

a top structure;

at least three scissor mechanisms each including a pair of beams having lower ends, centers and upper ends;

center connecting means for connecting each pair of beams at their centers;

a first pair of end connecting means for pivotally connecting said lower ends of said pair of beams of a first lower scissor mechanism to the base structure;

a second pair of end connecting means for pivotally connecting said upper ends of said pair of beams of said first scissor mechanism to said lower ends of said pair of beams of a second scissor mechanism;

a third pair of end connecting means for pivotally connecting said upper ends of said pair of beams of said second scissor mechanism to said lower ends of said pair of beams of a third scissor mechanism;

an extending means having first and second ends for extending the top structure relative to the base structure;

upper and lower mounting means for mounting the extending means to two of said at least three scissor mechanisms;

said lower mounting means including at least one lower side plate mounted so as to extend in substantially parallel relationship along a portion of one of said pair of beams of said first scissor mechanism and being pivotally mounted to said center connecting means and to one of said second pair of end connecting means, a first pivot means for pivotally mounting said first end of said extending means to said at least one lower side plate, said first pivot means being offset in spaced angled relationship from each of said center connecting means and said one of said second pair of end connecting means of said first scissor mechanism;

said upper mounting means including at least one upper side plate mounted so as to extend substantially parallel relative to and along a portion of one of said pair of beams of said third scissor mechanism and being diagonally oriented with respect to said a least one lower side plate, said at least one upper side plate being pivotally mounted to said center connecting means of said third scissor mechanism and one of said third end connecting means, a second pivot means for pivotally connecting said second end of said extending means to said at least one upper side plate in spaced and angled relationship from said center connecting means of said third scissor mechanism and said one of said third end connecting means;

whereby said upper and lower mounting means distribute forces from said extending means to said center connecting means of said first and third scissor mechanisms and said one of said second pair of end connecting means and said one of said third pair of end connecting means.

10. The aerial work platform of claim 9 in which each of said upper and lower mounting means includes upper side plates and lower side plates, respectively on both sides of said extending means.

11. The aerial work platform of claim 9 in which said extending means is a hydraulic cylinder.

12. The aerial work platform of claim 9 including a stress reducing member extending generally parallel to said extending means and pivotally mounted to each of said one of said second pair of end connecting means and said one of said third pair of end connecting means.

* * * * *